US006799495B2

(12) United States Patent
Jensen

(10) Patent No.: US 6,799,495 B2
(45) Date of Patent: Oct. 5, 2004

(54) TENSIONABLE BLADE AND BLADE ASSEMBLY FOR A WEDGE CUT PRODUCT

(76) Inventor: Raliegh J. Jensen, 1986 Silvercreek La., Boise, ID (US) 83706

( * ) Notice: Subject to any disclaimer, the term of this patent is extended or adjusted under 35 U.S.C. 154(b) by 0 days.

(21) Appl. No.: 10/078,325

(22) Filed: Feb. 15, 2002

(65) Prior Publication Data

US 2002/0124709 A1 Sep. 12, 2002

Related U.S. Application Data

(63) Continuation of application No. 09/826,452, filed on Apr. 4, 2001, which is a continuation of application No. 09/550,538, filed on Apr. 14, 2000, now Pat. No. 6,601,491, which is a continuation-in-part of application No. 09/008,551, filed on Jan. 16, 1998, now abandoned.

(60) Provisional application No. 60/269,619, filed on Feb. 15, 2001, and provisional application No. 60/046,096, filed on May 9, 1997.

(51) Int. Cl.[7] ..... B26D 1/03; B26D 5/00

(52) U.S. Cl. ..... 83/62.1; 83/581.1; 83/856; 83/857; 83/932; 30/303

(58) Field of Search ..... 83/62, 62.1, 402, 83/404.3, 405, 425.2, 425.3, 435.15, 581.1, 651.1, 662, 694, 699.51, 699.61, 856, 857, 858, 932; 30/117, 299, 303, 304, 305; D7/381, 673

(56) References Cited

U.S. PATENT DOCUMENTS 690,512 A 1/1902 Boos ..... 30/303 X
1,045,988 A * 12/1912 Larsen ..... 83/581.1
1,097,479 A 5/1914 Starr ..... 83/858
1,565,846 A * 12/1925 Cantey ..... 83/581.1
1,695,761 A 12/1928 Hecker ..... 30/303
2,192,141 A 2/1940 McElwaine ..... 137/505.23
2,397,974 A 4/1946 Morrow et al. ..... 83/62
2,500,321 A 3/1950 Petersen ..... 83/62.1
2,563,237 A * 8/1951 Grocoff ..... 83/651.1
2,607,373 A 8/1952 Crane ..... 83/62.1
3,112,781 A 12/1963 Popeil ..... 83/435.15
3,216,474 A 11/1965 Popeil ..... 83/662
3,519,048 A 7/1970 Reifenhauser ..... 83/168
4,137,807 A 2/1979 Schaumberg ..... 83/599
4,982,638 A 1/1991 Brussel ..... 83/614
5,343,623 A 9/1994 Cole et al. ..... 30/304
5,911,808 A 6/1999 Mendenhall ..... 83/402 X
6,047,625 A * 4/2000 Mendenhall ..... 83/856

* cited by examiner

*Primary Examiner*—Clark F. Dexter
(74) *Attorney, Agent, or Firm*—Joseph W. Holland

(57) ABSTRACT

A blade assembly for cutting a food product such as potatoes or vegetables in a wedge configuration. The blade assembly includes a blade head to which a blade is attached and tensioned by a tensioning assembly. The blade is attached to the blade head with a first end restrained by a first end retainer, a second end restrained by a second end retainer, a first bend positioned about a first return of the blade head, a second bend positioned about a second return of the blade head. The blade also includes a first leg segment extending in a first plane across an aperture of the blade head, and a second leg segment extending across the aperture of the blade head in a second plane at an angle to the first leg segment. The blade assembly for cutting a food product may also include a blade failure sensing device.

15 Claims, 7 Drawing Sheets

TENSIONABLE BLADE AND BLADE ASSEMBLY FOR A WEDGE CUT PRODUCT

RELATED APPLICATIONS

This application claims the benefit of U.S. Provisional Application No. 60/269,619, filed Feb. 15, 2001 and a continuation of U.S. application Ser. No. 09/826,452 (Apr. 4, 2001), which is a continuation of Ser. No. 09/550,538 (Apr. 14, 2000), now U.S. Pat. No. 6,601,491 which is a continuation-in-part of Ser. No. 09/008,551 (now abandoned), which claimed the benefit of No. 60/046,096 (May 5, 1997).

BACKGROUND OF THE INVENTION

1. Technical Field

This invention relates to the cutting of food product. In particular it relates to a tensionable serpentine blade and blade assembly for cutting food product.

2. Background Art

Devices for cutting food products into slices are well-known in the art and typically comprise a stationary array of cutting knives with a means to propel the food product through the knife array. The food product may be conveyed through the knife array by entraining it in a fluid stream, or in the alternative may be conveyed by mechanical or pneumatic means. Alternately, food product may be conveyed by a hydraulic plunger.

A typical hydraulic food cutting apparatus in use today has a receiving tank filled with a hydraulic carrier fluid, usually water, into which food product is dumped. A food pump draws its suction from the receiving tank, and pumps carrier fluid and the suspended food product from the tank into a segment of tube. The tube aligns the food product within the hydraulic carrier fluid for impingement upon a cutter blade assembly. The stationary knife array typically includes a plurality of knife blades mounted parallel to each other. If the food product is to be cut into slices, only a single such array need be utilized. However, if the food product is to be cut into sticks, such as potatoes for french fries, two such arrays are utilized with the knives in one array extending generally perpendicular to the knives in the other array.

Cole, et.al., U.S. Pat. No. 5,343,623 Knife Assembly for Cutting a Food Product, discloses a knife blade having a cutting portion defining a cutting edge which is mounted in the knife assembly such that a tension force is exerted on the knife blade in the plane of the cutting edge. The cutting edges of knives in the array are located in a common plane. Cole, et.al, further discloses an apparatus for mounting the individual knife blades for applying the requisite tension to the individual blades.

There may be advantage in providing a tensionable serpentine blade and blade assembly which allows for the cutting of food product which renders a cut food product having a wedge cross sectional configuration.

There may be advantage in providing a tensionable serpentine blade and blade assembly which allows for the cutting of food product which renders a cut food product having a wedge cross sectional configuration that includes a device for sensing a failure or breakage of a tensionable serpentine blade.

SUMMARY OF THE INVENTION

The present invention is directed to a blade assembly including a tensionable serpentine blade. The blade assembly includes a blade head including a first return, a second return and a transecting passage connecting the first return and the second return. The blade head also includes a first end retainer for retaining a first end of the blade and a tensioning assembly including a second end retainer for retaining a second end of the serpentine blade, the tensioning assembly configured to apply a tension along the length of the blade. When positioned on the blade head, the blade includes a first end and a second end, a first bend, a second bend, a first leg segment connecting the first bend and the second bend, and a second leg segment connecting to and extending from the second bend.

The blade head defines an aperture through which food product is passed for cutting. The blade is mounted to the blade head by fixing a first end of the serpentine blade in the first end retainer, passing the second end across the aperture on a first plane, about the first return, through the transecting passage connecting the first return and the second return, about the second return, across the aperture again on a second plane and fixing a second end of the blade in a second end retainer. A tensioning member provides tensioning along the length of the blade. An assembly as described, when placed in use, will render a cut product having four segments, each segment having a wedge shaped cross-sectional configuration. The blade head may be configured to allow stacking of first and second blade heads, such that the second blade head is rotated 90° to the first blade head. A stacked blade assembly, when placed in use, will render a cut product having eight segments each having a cut angle substantially equal to 45°.

The transecting passage is configured to permit passage of the serpentine blade from the first return to the second return such that a first leg of the serpentine blade lies across the aperture in substantially a first plane and a second leg of the serpentine blade lies across the aperture in substantially a second plane that lies substantially parallel to the first plane. The face of the first leg and the face of the second leg of the serpentine blade lie on intersecting planes such that, as a food product is passed through the aperture and across the first leg and the second leg of the serpentine blade, the food product is rendered to cut food product having a wedge shaped cross sectional configuration.

In one embodiment of the invention, various component parts of the blade head are machined of type 17-4 PH stainless steel, although other materials and forming methods known to those skilled in the art may be employed to practice the present invention.

In one preferred embodiment of the invention, the blade may be formed of a strip of sheet metal having a thickness of 0.005 inches to 0.0015 inches and a width of 0.375 inches to 0.625 inches. In one embodiment of the invention, the serpentine blade is formed of a hardened 301 stainless steel having a thickness of 0.008 inches and a width of 0.50 inches.

The material used to form the blade should exhibit adequate tensile strength to perform as a blade and adequate ductility to allow its continuous configuration. The material used to form the blade should also exhibit a yield strength less than the tensile strength. The blade may be formed of a strip of sheet metal having a tensile strength of 175,000 psi to 275,000 psi and a yield strength of 80,000 psi to 180,000 psi. In one embodiment of the invention, the blade is formed from a hardened type 301 stainless steel having a tensile strength of approximately 185,000 psi and a yield strength of approximately 140,000 psi.

Materials having compositions or properties similar to the hardened 301 series stainless steel, or 17-4 PH stainless steel, are known to those skilled in the art and may be employed in the present invention as a blade.

In one preferred embodiment of the invention, the tensioning member includes a tension adjustment screw disposed between the second end retainer and a fixed portion of the blade head.

In one preferred embodiment of the invention, the blade comprises a strip of material tensioned to a force approximating, but not exceeding, the yield strength of the material used to form the blade.

In one preferred embodiment of the invention, the first return and the second return each comprise a height substantially equal to a width of the blade configured to transfer a substantially equal tensile force across the width of the blade.

In one preferred embodiment of the invention, the first return and the second return each comprise a bearing face inclined at an angle in the range of 1° to 10°.

In one preferred embodiment of the invention, the tensionable blade assembly includes a device for sensing a failure or breakage of a tensionable blade. The failure sensing device includes a fluid containment cell and a pressure release mechanism. The failure sensing device also includes a fluid pressure source fluidly connected to the fluid containment cell. The fluid containment cell may be configured as a cylinder formed in the cutting assembly head. The pressure release mechanism includes a stop which is configured to compressively mate against a seat formed in an aperture located in an end of the cylinder. When the stop is compressively mated against the seat, fluid will not escape from the fluid pressure chamber and pressure may be maintained within the chamber. The stop opposes the seat and cooperates with a compressive member for holding the stop against the seat of the fluid pressure chamber and sealing the fluid pressure chamber.

DETAILED DESCRIPTION

Figure 1:
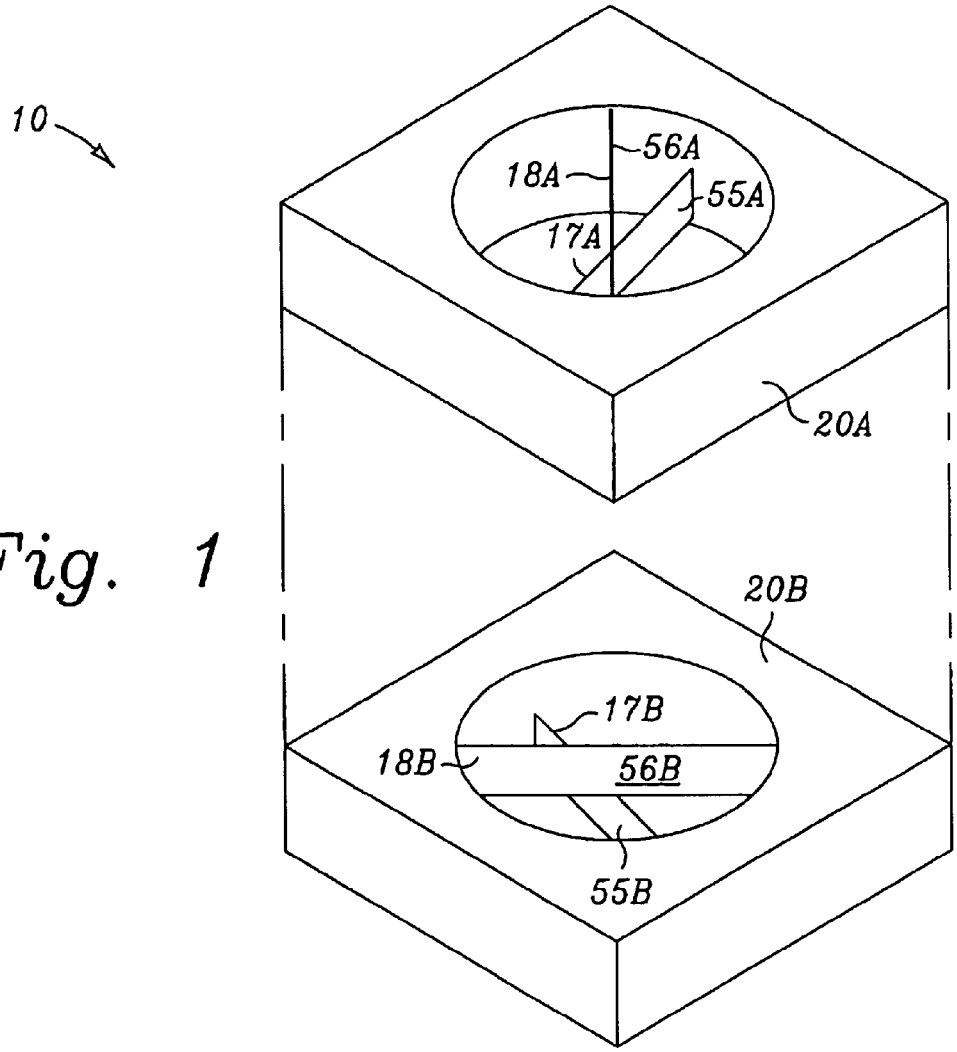
FIG. 1 is a representational exploded schematic perspective view of a blade assembly.
Figure 2:
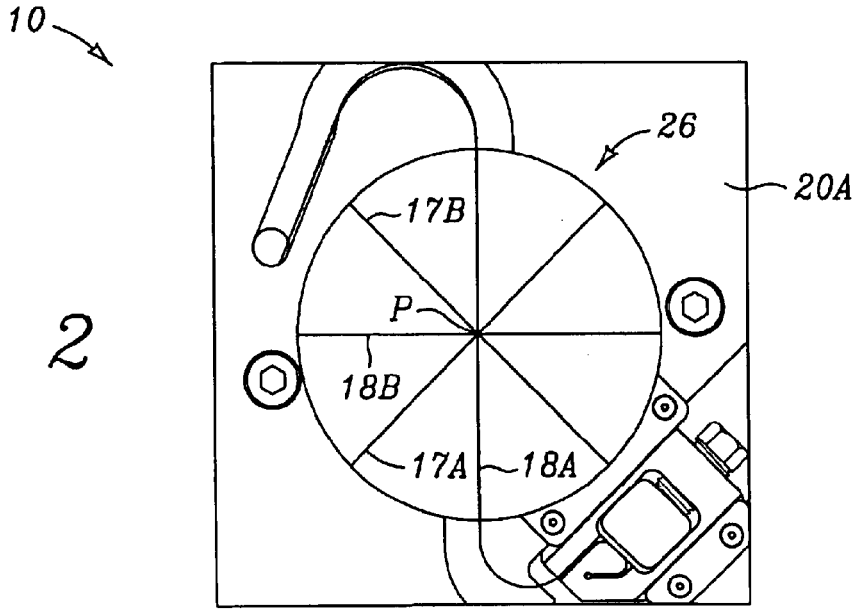
FIG. 2 is a representational top view of a blade assembly.

Referring to FIGS. 1 and 2, blade assembly 10 is shown for the purpose of illustrating the intersecting orientation of face 55A of first leg segment 17A and face 56A of second leg segment 18A of first blade head 20A. Also shown is the intersecting orientation of face 55B of first leg segment 17B and face 56B of second leg segment 18B of second blade head 20B. When first blade head 20A and second blade head 20B are assembled in a stacked configuration, as more fully described herein, the resulting blade assembly 10, as shown in FIG. 2, presents cutting array 26.

Figure 3:
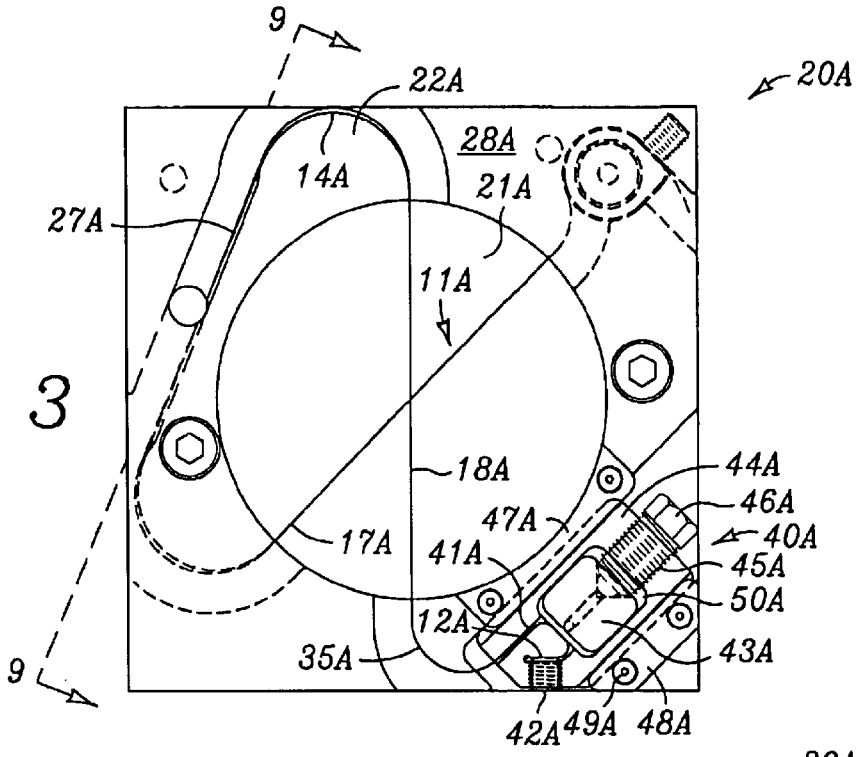
FIG. 3 is a representational top view of a first blade head.
Figure 4:
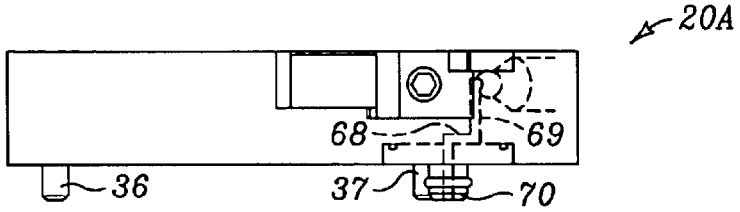
FIG. 4 is a representational side view of a first blade head.
Figure 5:
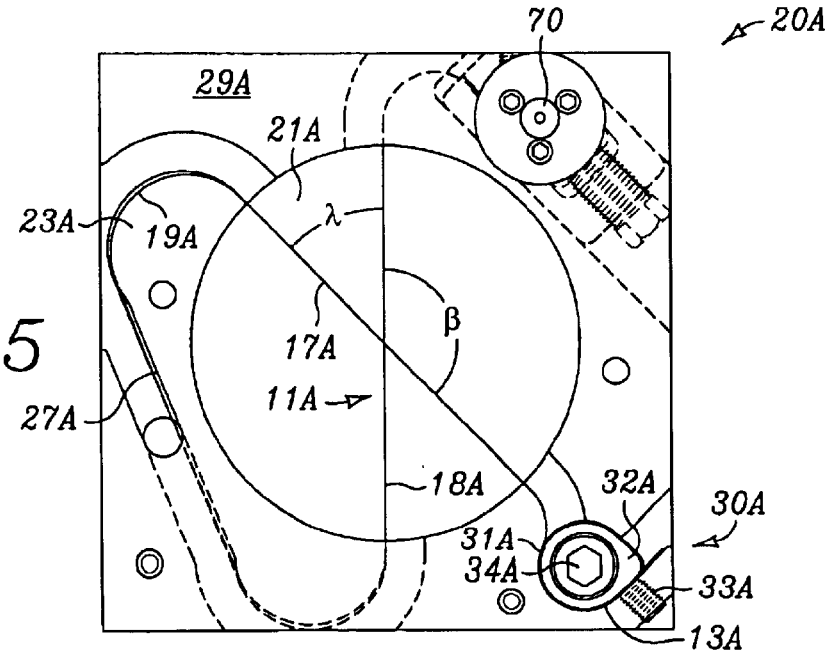
FIG. 5 is a representational bottom view detail of a first blade head.

Referring to FIGS. 3–5, first blade head 20A will be more fully described. Aperture 21A is formed on first blade head first face 28A and extends through first blade head 20A to first blade head second face 29A, shown in FIG. 5. Blade head 20A also includes first return 22A, shown in FIG. 3, and tensioning assembly 40A, shown in FIG. 3, and second return 23A and second end retainer assembly 30A, shown in FIG. 5.

Referring to FIG. 3, first end 12A of blade 11A curves about tensioner return 35A and enters first end blade retainer passage 41A. Lock screw 42A secures second end 13A of blade 11A in first end blade retainer passage 41A. First end blade retainer passage 41A is formed in a first end of puller 44A such that when first end 12A of blade 11A is secured by lock screw 42A, blade 11A is secured to and will move with puller 44A. First leg segment 17A of blade 11A extends across aperture 21A and curves about first return 22A at bend 14A entering transecting passage 27A.

Figure 9:
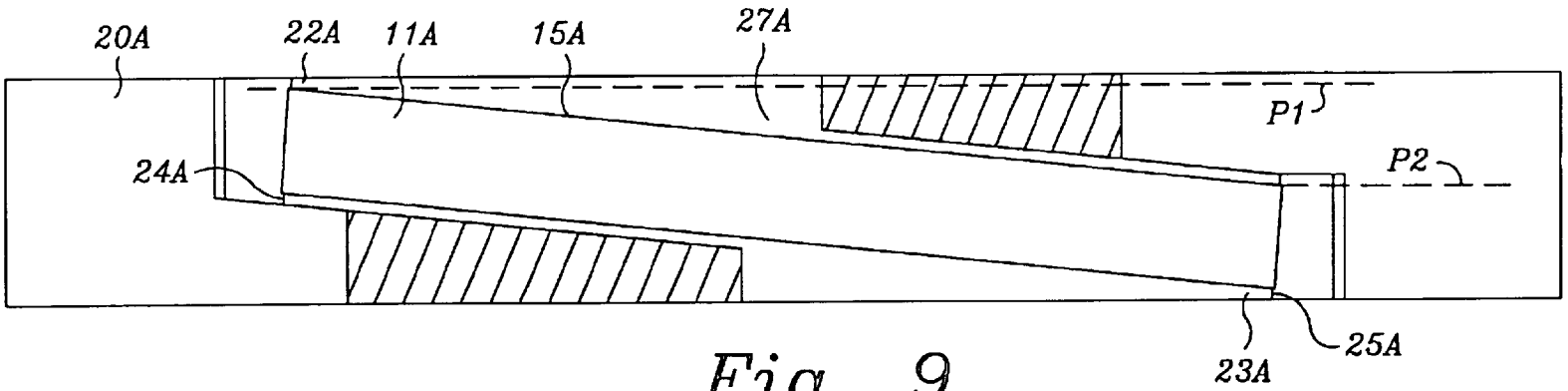
FIG. 9 is a representational sectional view taken of first blade head showing a transecting passage.

FIG. 9 shows blade head 20A including blade 11A proceeding along an inclined plane of transecting passage 27A. Blade 11A enters transecting passage 27A with leading edge 15A of blade 11A in a first plane P1 and exits transecting passage 27A with leading edge 15A of blade 11A in a second plane P2.

Referring To FIG. 4, first blade head 20A is shown including first locator pin 36 and second locator pin 37 which are employed when attaching first blade head 20A to second blade head 20B.

Referring to FIG. 5, second end 13A of blade 11A exits transecting passage 27A and proceeds around return 23A. Second leg segment 18A of blade 11A extends across aperture 21A at an angle to first leg segment 17A of blade 11A and then passes into second end retainer assembly 30A. More particularly, second end 13A of blade 11A passes through second end blade passage 31A and is wrapped about a portion of a circumference of boss 32A. Set screw 33A retains boss 32A and lock screw 34A provides a compressive force between an end of set screw 33A and blade 11A against boss 32A.

Figure 12:
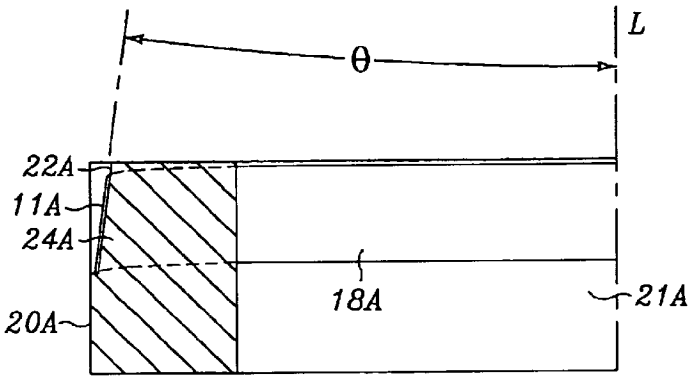
FIG. 12 is a representational side cutaway view detail of a tensioning assembly showing an inclined bearing face of a return.

In a preferred embodiment of the invention, first return 22A, seen in FIG. 3, includes first inclined bearing face 24A inclined in the range of 1° to 10° from axis A, as shown in FIG. 12. This configuration is typical of second return 23A which includes second inclined bearing face 25A inclined in the range of 1° to 10°. This configuration is typical of second blade head 20B as well, where first return 22B includes an inclined bearing face inclined in the range of 1° to 10° and second return 23B includes an inclined bearing face inclined in the range of 1° to10°. This feature of the invention may reduce binding of blade 11A against first inclined bearing face 24A of first return 22A and second inclined bearing face 25A of second return 23A as blade 11A enters and exits transecting passage 27A.

Figure 6:
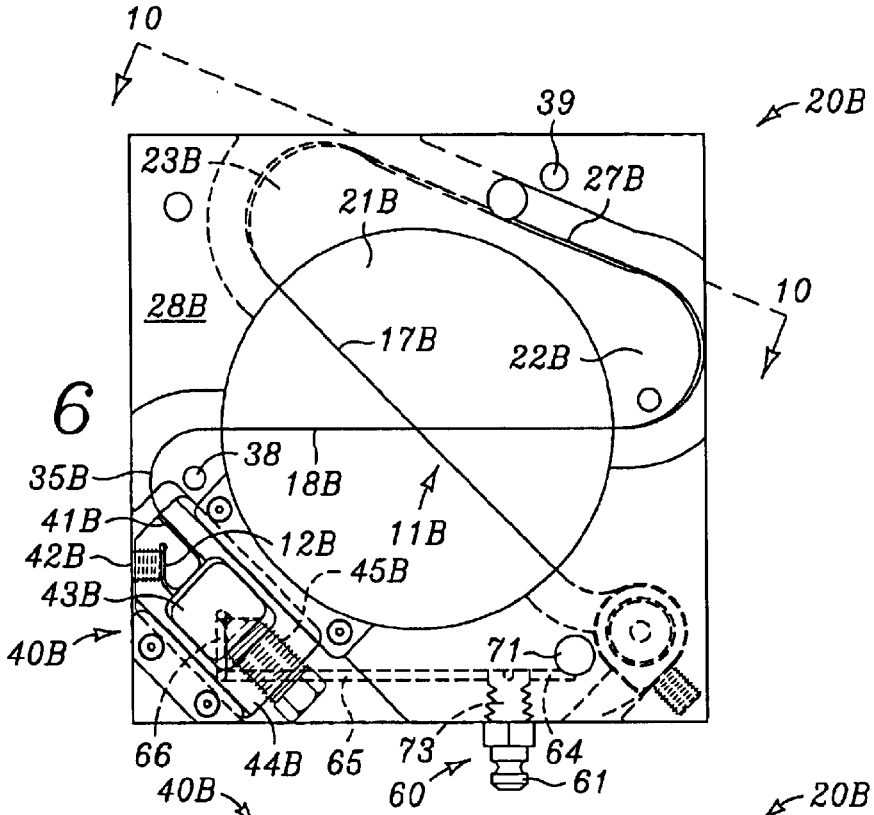
FIG. 6 is a representational top view of a second blade head.
Figure 7:
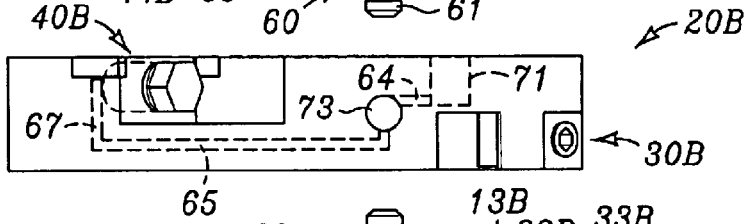
FIG. 7 is a representational side view of a second blade head.
Figure 8:
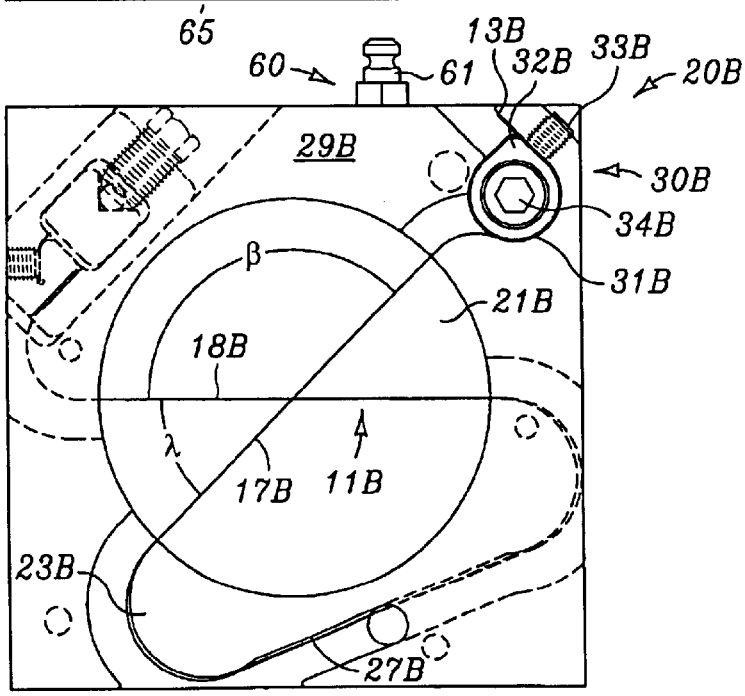
FIG. 8 is a representational bottom view detail of a second blade head.

Referring to FIGS. 6–8, second blade head 20B will be more fully described. Aperture 21B is formed on second blade head first face 28B and extends through second blade head 20B to second blade head second face 29B, shown in FIG. 8. Blade head 20B also includes first return 22B and tensioning assembly 40B, shown in FIG. 6, and second return 23B and second end retainer assembly 30B, shown in FIG. 8.

Referring to FIG. 6, first end 12B of blade 11B curves about tensioner return 35B and enters first end blade retainer passage 41B. Lock screw 42B secures second end 13B of blade 11B in first end blade retainer passage 41B. First end blade retainer passage 41B is formed in a first end of puller 44B such that when first end 12B of blade 11B is secured by lock screw 42B, blade 11B is secured to and will move with puller 44. First leg segment 17B of blade 11B extends across aperture 21B and curves about first return 22B entering transecting passage 27B.

Figure 10:
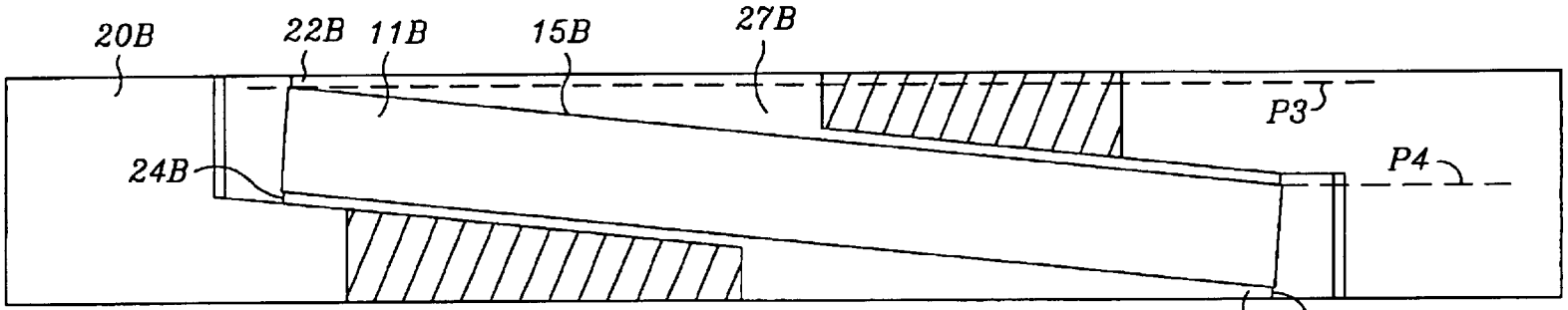
FIG. 10 is a representational sectional view taken of the second blade head showing a transecting passage.

FIG. 10 shown blade head 20B including blade 11B proceeding along an inclined plane of transecting passage 27B. Blade 11B enters transecting passage 27B with leading edge 15B of blade 11B in a third plane P3 and exits transecting passage 27B with leading edge 15B of blade 11B in a fourth plane P4.

Referring to FIG. 6 first locator aperture 38 and second locator aperture 39 are shown formed in face 28B of second blade head 20B. First locator aperture 38 and second locator aperture 39 align with and insert into first locator pin 36 and second locator pin 37, shown in FIGS. 4 and 5, to provide alignment and rotational orientation when attaching first blade head 20A to second blade head 20B.

Referring to FIG. 8, second end 13B of blade 11B exits transecting passage 27B and proceeds around return 23B. Second leg segment 18B of blade 11B extends across aperture 21B at an angle to first leg segment 17B of blade 11B and then passes into second end retainer assembly 30B. More particularly, second end 13B of blade 11B passes through second end blade passage 31B and is wrapped about a portion of a circumference of boss 32B. Set screw 33B retains boss 32B and lock screw 34B provides a compressive force between an end of set screw 33B and blade 11B against boss 32B.

Referring to FIGS. 3, 5, 6 and 8, first end 12A and second end 13A of blade 11A and first end 12B and second end 13B of blade 11B may include a rolled or crimped end to reduce the potential for pull out from either first or second end retainer assemblies 30A and 30B or second end blade retainer passages 41A and 41B.

Referring to FIG. 3, tensioning assembly 40A is shown and is typical of tensioning member 40B of second blade head 20B shown in FIG. 6. Tensioning assembly 40A includes post 43A which is preferably integral to first blade head 20A and is formed by milling away material from first blade head first face 28A to provide post 43A. Puller 44A includes aperture 50A which preferably includes a width substantially equal to and greater than a width of post 43A and a length greater than a length of post 43A. Puller 44A also includes threaded aperture 45A which extends through a second end of puller 44A along an axis substantially parallel to the length of puller 44A. Tensioning screw 46A threadedly engages threaded aperture 45A and an end of tensioning screw 46A impinges against post 43A. As tensioning screw 46A is advanced through threaded aperture 45A puller 44A is drawn in a direction opposite the advancement of tensioning screw 46A applying a tensive force to blade 11A. Tensioning assembly 40A also includes first keeper 47A and second keeper 48A which attach by screws 49A to first blade head first face 28A to retain puller 44A in position over post 43A.

Figure 11:
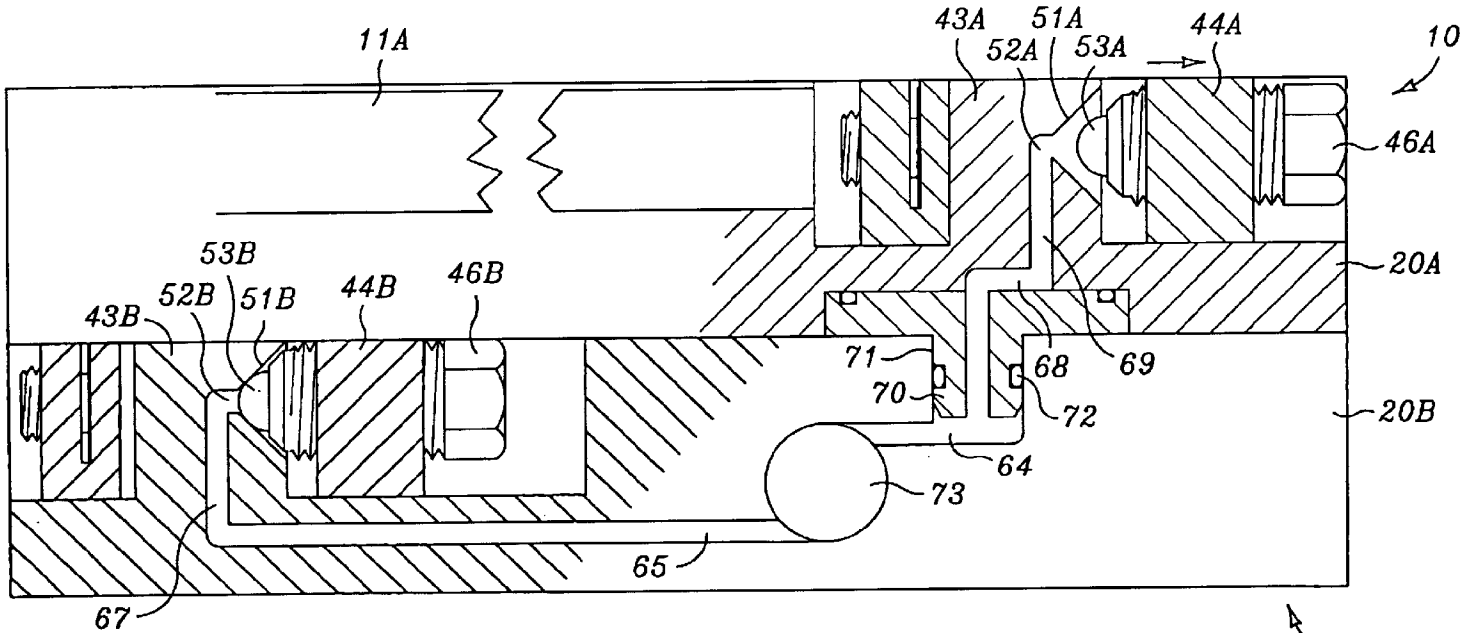
FIG. 11 is a representational side cutaway schematic of a blade assembly showing features of a failure sensing system.

Referring to FIG. 1, face 55A of first leg segment 17A and face 56A of second leg segment 18A traverse aperture 21A in planes which extend at intersecting angles. Similarly, face 55B of first leg segment 17B and face 56B of second leg segment 18B traverse aperture 21B in planes which extend at intersecting angles. Additionally, in the preferred embodiment of the invention all leg segment traverse the aperture different planes which extend at intersecting angles. These intersecting angles are determined by the size, location and configuration of first returns 22A and 22B, second returns 23A and 23B, transecting passages 27A and 27B, first end blade passages 31A and 31B and second end blade retainer passages 41A and 41B. In a preferred embodiment of the invention, and referring to FIGS. 5 and 8, angle $\lambda$ is substantially equal to 45° and angle $\beta$ is substantially equal to 135°. When first blade head 20A and second blade head 20B are assembled, as shown in FIGS. 2 and 11, second blade head 20B is rotated 90° in relation to first blade head 20A about a center point P, shown in FIG. 2, resulting in blade array 26 which includes a plurality of cut angle $\lambda$ each substantially equal to 45°, as shown in FIG. 2. It should be recognized that other wedge configurations may be achievable.

Referring to FIGS. 4, 6, 7, 8 and 11, failure sensing system 60 will be described in detail. As seen in FIGS. 6 and 8 includes inlet fitting 61 which is pneumatically connected to a source of pressurized air for failure sensing system 60. Failure sensing system 60 inlet fitting 61 pneumatically communicates with fluid containment chamber 73 of second blade head 20B, shown in FIGS. 6, 7 and 11, which in turn pneumatically communicates with first connector fluid containment passage 65, shown in FIGS. 6 and 11. First connector fluid containment passage 65 extends internally through second blade head 20B along a path that intersects first branch fluid containment passage 66, shown in FIG. 6. First branch fluid containment passage 66 intersects with first fluid containment riser passage 68 which extends into post 43B, as shown in FIGS. 7 and 11.

Referring to FIG. 11, post 43B is shown including seat 51B. Branch fluid containment passage 66 pneumatically communicates with orifice 52A which extends through post 43B terminating at seat 51B. Ball 53B seals orifice 52B at seat 51B as tensioning screw 46B threadedly engages threaded aperture 45B.

Referring to FIG. 11, chamber 73 also pneumatically communicates second connector fluid containment passage 64 which in turn pneumatically communicates with nipple receiver 71. Nipple 70 attaches to blade head second face 29A of blade head 20A as shown in FIGS. 3, 4 and 11. Nipple 70 pneumatically communicates with nipple receiver 71 formed in first face 28B of second blade head 20B and shown in FIGS. 6, 7 and 11. O-ring 72 seen in FIG. 11, provides an air tight seal at the connection.

Referring to FIGS. 4 and 11, third connector fluid containment passage 68 pneumatically communicates with nipple receiver 71 at one end and with second fluid containment riser passage 69 at a second end. Second fluid containment riser passage 69 extends into post 43A, as shown in FIGS. 4 and 11. Post 43A, which is typical of post 43B is shown including seat 51A, as seen in Figure, second fluid containment riser passage 69 pneumatically communicates with orifice 52A which extends through a second end of puller 44A into seat 51A. Ball 53A seals orifice 52A at seat 51A as tensioning screw 46A threadedly engages threaded aperture 45A tension is put on blade 11A.

Figure 13:
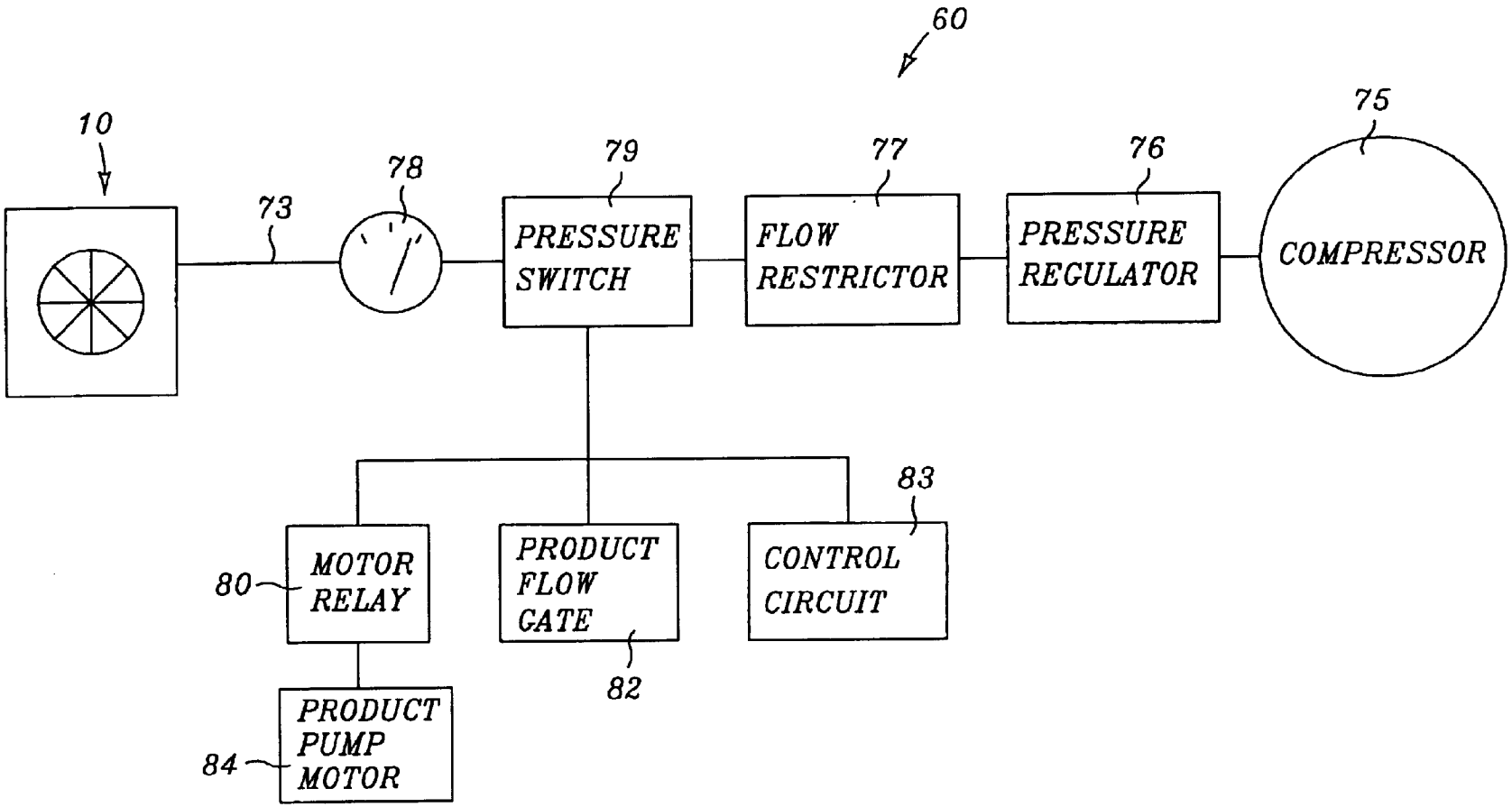
FIG. 13 is a schematic representation of a failure sensing system.

FIG. 13 failure sensing device 60 is shown including air line 73 which is removably attachable to blade assembly 10. Pressure is provided to the system by a pressure source, in this instance, compressor 75. Pressure is regulated from the compressor by pressure regulator 76 and flow may be restricted by flow restricter 77. Pressure gauge 78 senses and displays system pressure. Pressure switch 79 is shown fluidly connected in series with compressor 75 and air line 73. In the event of a failure or breakage of first blade 11A or second blade 11B, shown in FIG. 2, air begins to escape at an interface of seat 51A and ball 53A of first blade head 20A and/or the interface of seat 51B and ball 53B of second blade head 20B as seen in FIG. 11. Air pressure for the system lowers activating pressure switch 79, seen in FIG. 14. As shown in FIG. 13, pressure switch 79 may be attached to a variety of components for signaling or controlling other components of the cutting system. FIG. 13 shows pressure switch 79 electrically connected to motor relay 80, product pump motor 84, product flow gate 82 and control circuit 83.

Operation of food product cutting system 100 may be terminated in any number of ways, most common of which is to effect a shut down of food product pump 102.

Figure 14:
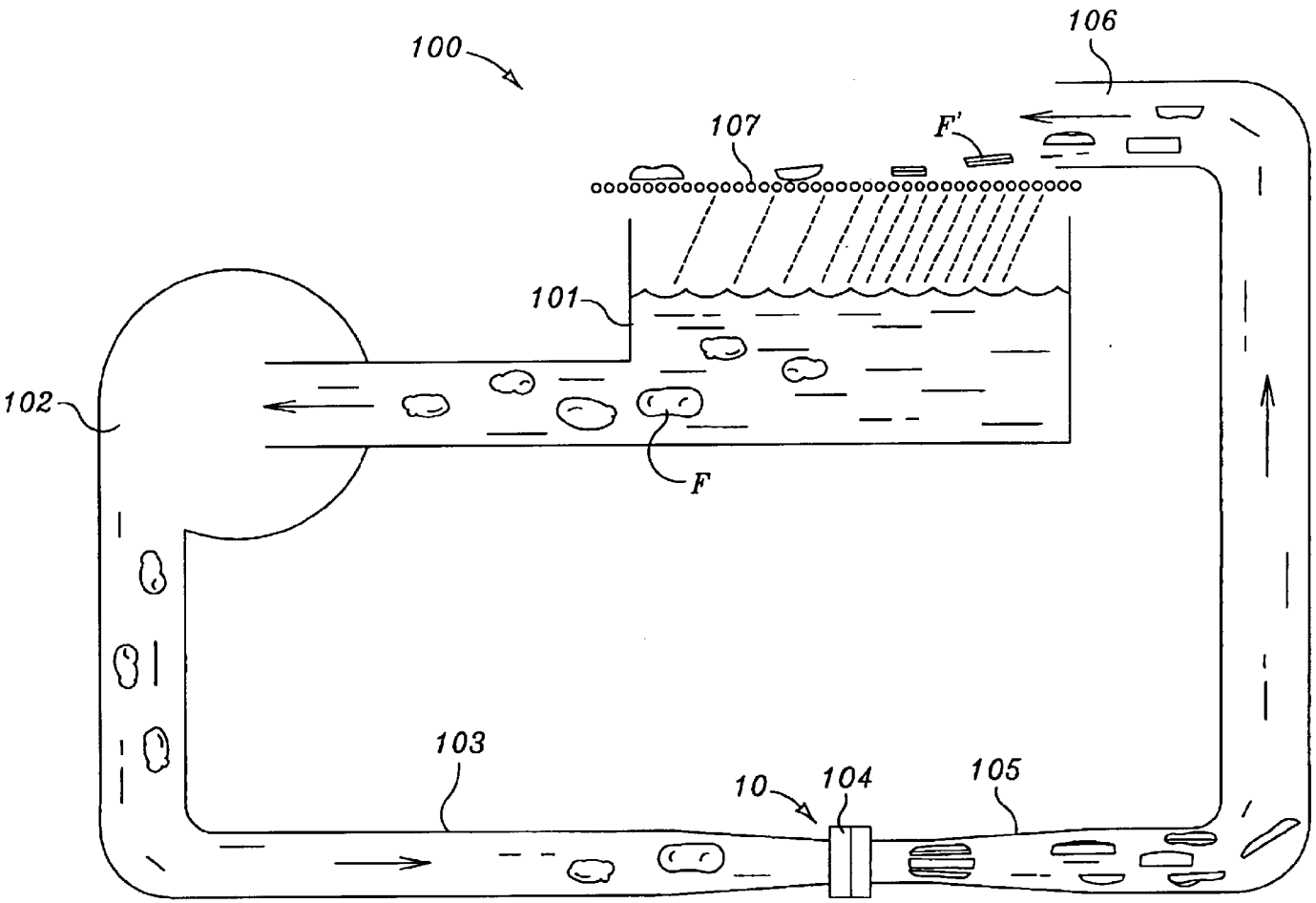
FIG. 14 is a schematic representation of a food product cutting system.

Referring to FIG. 14, food product cutting system 100 is shown including food product tank 101 containing water in which the food product is suspended. Food product F, such as raw, whole potatoes, are introduced into food product tank 101. Food product F and water are drawn through food pump 102 into inlet tube 103. At its downstream end, inlet tube 103 is fluidly connected to cutting assembly housing 104. Food product F passes through cutting assembly housing 104 including cutting assembly 10 and is discharged in outlet tube 105. From this point, the sliced food product F is carried through processed food product discharge 106 to de-watering conveyor 107.

While this invention has been described with reference to the detailed embodiments, this is not meant to be construed in a limiting sense. Various modifications to the described embodiments as well as the inclusion or exclusion of additional embodiments will be apparent to persons skilled in the art upon reference to this description. It is therefore contemplated that the appended claims will cover any such modifications or embodiments as fall within the true scope of the invention.

I claim:

1. A blade assembly comprising:

a blade head including a first return, a second return and a transecting passage connecting the first return and the second return;

the blade head also including a first end retainer attached to a first face of the blade head;

the blade head also including a tensioning assembly attached to a second face of the blade head, the tensioning assembly including a post, a puller and a second end retainer attached to the puller, the puller being movable with respect to the post;

and a blade attached to the blade head, the blade including a first end restrained by the first end retainer, a second end restrained by the second end retainer, a first bend positioned about the first return, a second bend positioned about the second return, a first leg segment extending across an aperture of the blade head in a first plane, and a second leg segment extending across the aperture of the blade head in a second plane at an angle to the first leg segment, whereby a tension is applied along a length of the blade by movement of the puller of the tensioning assembly with respect to the post of the tensioning assembly.

2. The blade assembly of claim 1 wherein the blade head further comprises:

first return including an inclined bearing face; and second return including an inclined bearing face.

3. The blade assembly of claim 1 wherein the blade head further comprises:

the blade head including an axis lying in a plane substantially perpendicular to the first face of the blade head;

the first return including an inclined bearing face inclined in the range of 1° to 10° with respect to the axis lying in a plane substantially perpendicular to the first face of the blade head; and the second return including an inclined bearing face inclined in the range of 1° to 10° with respect to the axis lying in a plane substantially perpendicular to the first face of the blade head.

4. The blade assembly of claim 1 wherein the first end retainer further comprises a set screw extending through the tensioning assembly impinging against the first end of the blade.

5. The blade assembly of claim 1 wherein the second end retainer further comprises a set screw extending through the blade head and impinging against the second end of the blade.

6. The blade assembly of claim 1 wherein the tensioning assembly further comprises:

the post being formed on a first side of the blade head;

the puller being a slideable-puller including an aperture allowing placement over the post, the puller also including a threaded aperture extending through a first end of the puller;

a tensioning screw extending through the thread aperture and impinging against the post; and a puller retainer for retaining the puller in position over the post.

7. The blade assembly of claim 1 further comprising:

a pneumatic blade failure sensing device including a fluid containment passage;

a pressure release mechanism fluidly connected to the fluid containment passage;

a fluid pressure source fluidly connected to the fluid containment passage;

a fluid pressure release configured to release pressure from the fluid containment passage in the event of a failure of the blade; and a fluid pressure sensing device fluidly connected to the fluid containment passage for sensing a decrease in pressure in the fluid containment passage.

8. A blade assembly comprising:

a first blade head including a first return, a second return and a transecting passage connecting the first return and the second return;

the first blade head also including a first end retainer attached to a first face of the first blade head;

the first blade head also including a first tensioning assembly attached to a second face of the first blade head, the first tensioning assembly including a post, a puller and a second end retainer attached to the puller of the first tensioning assembly, the puller of the first tensioning assembly being movable with respect to the post of the first tensioning assembly;

a second blade head connected to the first blade head in a stacked arrangement, the second blade head including a first return, a second return and a transecting passage connecting the first return and the second return;

the second blade head also including a first end retainer attached to a first face of the second blade head;

the second blade head also including a second tensioning assembly attached to a second face of the second blade head, the second tensioning assembly including a post, a puller and second end retainer attached to the puller of the second tensioning assembly, the puller of the second tensioning assembly being movable with respect to the post of the second tensioning assembly;

a first blade attached to the first blade head, the first blade including a first end restrained by the first end retainer of the first blade head, a second end restrained by the second end retainer of the first tensioning assembly, a first bend positioned about the first return of the first blade head, a second bend positioned about the second return of the first blade head, a first leg segment extending across an aperture of the first blade head in a first plane, and a second leg segment extending across the aperture of the first blade head in a second plane at an angle to the first leg segment, whereby a tension is applied along a length of the blade by movement of the puller of the first tensioning assembly with respect to the post of the first tensioning assembly; and a second blade attached to the second blade head, the second blade including a first end restrained by the first end retainer of the second blade head, a second end restrained by the second end retainer of the second tensioning assembly, a first bend positioned about the first return of the second blade head, a second bend positioned about the second return of the second blade heed, a first leg segment extending across an aperture of the second blade head in a third plane, and a second leg segment extending across the aperture of the second blade head in a fourth plane at an angle to the first leg segment, whereby a tension is applied along a length of the second blade by movement of the puller of the second tensioning assembly with respect to the post of the second tensioning assembly.

9. The blade assembly of claim 8 further comprising the second blade head rotated 90° relative to the first blade head.

10. The blade assembly of claim 8 wherein the first blade head further comprises:

the first return of each blade head including an inclined bearing face; and the second return of each blade head including an inclined bearing face.

11. The blade assembly of claim 8 wherein the first blade head further comprises:

the first blade head including an axis lying in a plane substantially perpendicular to the first face of the first blade head;

the first return including an inclined bearing face inclined in the range of 1° to 10° with respect to the axis lying in a plane substantially perpendicular to the first face of the first blade head; and the second return including an inclined bearing face inclined in the range of 1° to 10° with respect to the axis lying in a plane substantially perpendicular to the first face of the first blade head.

12. The blade assembly of claim 8 wherein the first end retainer of the first head further comprises a set screw extending through the first blade tensioning assembly impinging against the first of the first blade.

13. The blade assembly of claim 8 wherein the second end retainer of the first head further comprises a set screw extending through the first blade head and impinging against the second end of the first blade.

14. The blade assembly of claim 8 wherein the first tensioning assembly further comprises:

the post being formed on a first side of the first blade head;

the puller being a slideable puller including an aperture allowing placement over the post, the puller also including a threaded aperture extending through a first end of the puller;

a tensioning screw extending through the threaded aperture and impinging against the post; and a puller retainer for retaining the puller in position over the post.

15. The blade assembly of claim 8 further comprising:

a pneumatic blade failure sensing device including a fluid containment passage;

a pressure release mechanism fluidly connected to the fluid containment passage, a fluid pressure release configured to release pressure from the fluid containment passage in the event of a failure of the blade; and a fluid pressure sensing device fluidly connected to the fluid containment passage for sensing a decrease in pressure in the fluid containment passage.

* * * * *